US005972869A

United States Patent [19]

Cao et al.

[11] Patent Number: 5,972,869

[45] Date of Patent: Oct. 26, 1999

[54] MILDLY ACIDIC LAUNDRY DETERGENT COMPOSITION PROVIDING IMPROVED PROTECTION OF FINE FABRICS DURING WASHING AND ENHANCED RINSING IN HAND WASH

[75] Inventors: Hoai-Chau Cao, Liege; Marie-Christine Houben, Alleur; Patricia Pagnoul, Fooz, all of Belgium

[73] Assignee: Colgate-Palmolive Co, New York, N.Y.

[21] Appl. No.: 08/768,356

[22] Filed: Dec. 17, 1996

[51] Int. Cl.[6] ..... C11D 1/04; C11D 1/83; C11D 9/00; C11D 1/72

[52] U.S. Cl. ..... 510/292; 510/191; 510/220; 510/235; 510/238; 510/245; 510/276; 510/289; 510/290; 510/292; 510/316; 510/317; 510/340; 510/350; 510/351; 510/353; 510/355; 510/356; 510/357; 510/362; 510/365; 510/389; 510/399; 510/413; 510/414; 510/423; 510/424; 510/425; 510/491

[58] Field of Search ..... 510/191, 220, 510/235, 238, 245, 276, 289, 290, 292, 316, 317, 340, 350, 351, 353, 355, 356, 357, 362, 365, 389, 399, 413, 414, 423, 424, 425, 491, 437

[56] References Cited

U.S. PATENT DOCUMENTS

| | | | |
|---|---|---|---|
| 4,144,226 | 3/1979 | Crutchfield et al. | 528/231 |
| 4,315,092 | 2/1982 | Crutchfield et al. | 528/230 |
| 4,318,818 | 3/1982 | Letton et al. | 252/174.12 |
| 4,515,705 | 5/1985 | Moeddel | 252/174.12 |
| 4,597,898 | 7/1986 | Vander Meer | 252/529 |
| 4,637,890 | 1/1987 | Crabtree et al. | 252/90 |
| 4,894,177 | 1/1990 | Starch | 252/174.15 |
| 5,024,778 | 6/1991 | Grecsek | 252/140 |
| 5,254,290 | 10/1993 | Blandiaux et al. | 252/545 |
| 5,288,431 | 2/1994 | Huber et al. | 252/548 |
| 5,332,513 | 7/1994 | Doms et al. | 252/8.6 |
| 5,364,533 | 11/1994 | Ogura et al. | 210/645 |
| 5,393,468 | 2/1995 | Erilli et al. | 252/550 |
| 5,695,575 | 12/1997 | Angevaare et al. | 134/25.2 |

FOREIGN PATENT DOCUMENTS 0544944 6/1993 European Pat. Off. .

*Primary Examiner*—Mark Kopec
*Assistant Examiner*—Charles Boyer
*Attorney, Agent, or Firm*—Bernard Lieberman

[57] ABSTRACT

A mildly acidic laundry detergent composition is provided for the improved protection of fine fabrics during washing and enhanced removal of generated foam during rinsing in hand wash comprising:

a) at least one anionic surfactant; and/or b) at least one nonionic surfactant;

c) a rinse-active, pH-sensitive foam control agent comprising a fatty acid; whereby the fatty acid foam control agent remains substantially in acid form at the mildly acidic pH of the wash water so as to be essentially inoperative to suppress foam during washing, and whereby upon rinsing of the laundry with tap water having a pH of from about 7.5 to 8.5 at least of portion of said fatty acid is converted to a soap which functions to suppress foam during rinsing.

6 Claims, No Drawings

MILDLY ACIDIC LAUNDRY DETERGENT COMPOSITION PROVIDING IMPROVED PROTECTION OF FINE FABRICS DURING WASHING AND ENHANCED RINSING IN HAND WASH

BACKGROUND OF THE INVENTION

This invention relates to liquid or powder laundry detergent compositions. More particularly, it relates to a mildly acidic laundry composition capable of providing improved protection of delicate fabrics during washing and enhanced removal of foam during rinsing in hand wash operation.

Detergent compositions which are specially formulated as fine fabric compositions to refresh the fabric and remove light soils are known in the art. They can be adapted for use over a wide range of pH and are generally formulated using mild nonionic surfactants sometimes in combination with anionic surfactants.

Anionic surfactants are known to generate large amounts of foam primarily upon mechanical agitation of the wash bath during laundering, either by machine or by hand washing. However, large amounts of foam are often considered undesirable in European washing machines where excessive amounts of foam may interfere with the mechanical operation of the machine, such as, by foam overflow and interference with outlet pumping. Reducing the amount of foam in the wash bath has a further benefit. It enables the detergent to be readily rinsed from the laundered fabrics. This is particularly useful for hand wash and hand rinse operations where the repetitive steps of rinsing washed fabrics with rinse water to effect the complete removal of detergent can be time-consuming and often tedious.

It has now been recognized that for purposes of protecting fine fabrics from fiber damage resulting from agitation in the wash bath, the presence of foam or suds may have a beneficial effect insofar as it creates a type of air cushion which surrounds the fabric and protects it from undue friction during laundering. For sensitive and delicate fabrics such as wool and silk, such fiber protection is particularly important. However, the elimination of a foam control agent from a fine fabric detergent composition, while useful for fabric protection in the wash bath, adversely affects the problem of foam removal during rinsing. Consequently, there is a need in the art for a detergent composition for fine fabrics which contains a foam control agent which is selective for rinsing but which is inoperative during laundering.

U.S. Pat. No. 4,894,177 describes a delayed release antifoaming laundry additive wherein a silicone based antifoaming agent such as polydimethyl siloxane is adsorbed on a water soluble carrier in granular form such as modified cellulose. The absence of a foam suppresser significantly increases the number of rinses required to provide a washed fabric rinsed free of detergent. It is theorized that under actual laundering conditions, the antifoam agent will be released toward the end of the wash cycle, providing antifoam activity in the rinse water.

In U.S. Pat. No. 4,637,890 suds control prills are described containing fatty acid soap, quaternary ammonium salt and a silicone suds suppresser. According to the patent, the prills dissolve in the relatively high pH wash water (from about 9 to about 10.5) but the antifoam components do not become active until exposed to lower pH solutions, namely the water of the rinse cycle.

EP 544 944 Al describes rinse-active foam control particles for inclusion in a detergent composition consisting essentially of a soap of fatty acids. The particles of soap are intended to be present in both the wash cycle and the rinse cycle, and a silicone suds suppresser is recommended for use in the wash cycle in conjunction with the soap particles under described washing conditions.

SUMMARY OF THE INVENTION

The present invention provides a mildly acidic liquid laundry detergent composition capable of providing improved protection of fine fabrics during washing and enhanced removal of generated foam during rinsing in hand wash comprising:

a) at least one anionic surfactant; and/or b) at least one nonionic surfactant;

c) a rinse-active, pH-sensitive foam control agent comprising a fatty acid; said detergent composition being capable of generating a wash water pH in the range of from about 5.5 to 6.9 when added to wash water at a concentration sufficient to provide effective cleaning performance in the wash bath, whereby the fatty acid foam control agent remains substantially in acid form at the pH of the wash water so as to be essentially inoperative to suppress foam during washing, and whereby upon rinsing of the laundry with tap water having a pH of from about 7.5 to 8.5 at least a portion of said fatty acid is converted to a soap which functions to suppress foam during rinsing.

In accordance with the method invention, fine fabrics are able to be laundered with improved protection by foam during washing and enhanced removal of said generated foam during rinsing comprising:

(a) providing a wash bath containing an effective amount of a mildly acidic laundry detergent composition which generates a pH of from about 5.5 to 6.9 in the wash bath, said detergent composition comprising:
  (i) at least one anionic surfactant; and/or
  (ii) at least one nonionic surfactant; and
  (iii) a rinse-active, pH-sensitive foam control agent comprising a fatty acid; said wash water pH being sufficiently acidic to prevent the complete neutralization of the fatty acid to a soap;

(b) subjecting the fabrics to be laundered to a washing action in the wash bath whereby the fatty acid foam control agent remains substantially in acid form at the pH of the wash bath so as to be essentially inoperative to suppress foam during washing; and (c) rinsing the washed laundry of step (b) with tap water having a pH of from about 7.5 to 8.5 whereby at least a portion of said fatty acid is converted to a soap which functions to suppress foam during rinsing.

The present invention is predicated on the use of a rinse-active foam control agent comprising fatty acid which is maintained at a slightly acidic pH in the wash water so as to prevent the complete neutralization of the fatty acid to form a soap. The foam control agent is thereby, as a practical matter, inoperative to suppress foam or suds in the wash water. The laundry composition is formulated to be sufficiently acidic so as to generate a wash water pH when added in conventional dosage amounts to the water of from about 5.5 to 6.9, preferably from about 6 to 6.5.

Maintaining the wash water at a near neutral or mildly acidic pH has two beneficial consequences for laundering of fine fabrics. Firstly, a delicate fabric such as wool is not subjected to chemical degradation which ordinarily occurs in an alkaline wash medium. Wool fibers are very sensitive to damage in alkaline medium due to the breakdown of keratin, an outer cuticle of wool which serves as a protective layer. Consequently, the washing of a fine fabric such as wool in an alkaline medium is accompanied by a loss of strength of the wool fibers and an increased tendency to felting and yellowing.

The second benefit of forming a mildly acidic wash bath is the generation of a quick and high foam profile in the wash water to serve, in effect, as an air cushion surrounding the fine fabric and which protects it during the machine wash. The presence of extensive foam in the wash water minimizes the mechanical friction and movement of delicate fabric fibers in the wash, and preserves the color and mechanical integrity of the fabric.

Surprisingly, despite the high foam profile present during the wash, such foam can be readily eliminated after a relatively few rinses in hand rinse. The significant ease of rinsing which characterizes the product and method of the invention is due to the rapid increase in pH which is effected when going from the wash to the rinse. In ordinary laundering, both the wash liquor and rinse liquor generated by conventional fine fabric detergents, are predominantly alkaline, about pH 7.5 to 8.0 as dictated by the pH of tap water which is about 7.5 to 8.5. In contrast thereto, the present invention provides a slightly acidic wash medium, preferably about pH of 6.2, followed by rinsing in progressively alkaline medium up to around pH of 8.0, generally up to about a pH of 7.5, as governed by the pH of tap water. With each succeeding rinse the remaining detergent in the rinsed fabric is progressively reduced and the pH becomes correspondingly more alkaline. The remaining fatty acid in the detergent is progressively neutralized in situ and converted to a soap which further reacts with calcium or magnesium in the water (water hardness) to form an insoluble calcium or magnesium soap which is an effective antifoam agent. Consequently, the foam is significantly collapsed within a relatively few rinses, avoiding thereby the relatively laborious rinsing required in conventional hand rinsing operations.

It is to be understood that the higher the pH of tap water, the greater the differences in pH which can be effected between washing and rinsing, and the correspondingly greater ease of rinsing. Similarly, the higher the degree of water hardness, the greater the likelihood of its reaction with soap to form an effective antifoam agent in the rinse, and the correspondingly improved ease of rinsing.

DETAILED DESCRIPTION OF THE INVENTION

The mildly acidic detergent compositions of the invention are formulated to provide an acid to near neutral pH to a wash bath when used in conventional dosages. Ordinarily, for a liquid detergent composition formulated for fine fabrics an amount from about 60 to 100 ml of liquid detergent is added under European washing conditions to a European washing machine such as a Miele machine. For hand washing, an amount of from about 30 to 50 ml is typically added to a wash bath of about 5 liters. For granular detergent compositions, the corresponding amount added to a washing machine under European washing conditions is typically from about 80 to 130 grams, and for hand washing, the corresponding amount is from about 15 to 25 grams in 5 liters of water.

Suitable anionic surfactants include the water soluble alkali metal salts having alkyl radicals containing from about 8 to about 22 carbon atoms, the term alkyl being used to include the alkyl portion of higher acyl radicals. Examples of suitable synthetic anionic detergent compounds are sodium and potassium alkyl sulfates, especially those obtained by sulfating higher ($C_8$–$C_{18}$) alcohols produced, for example, from tallow or coconut oil; sodium and potassium alkyl ($C_9$–$C_{20}$) benzene sulfonates, particularly sodium linear secondary alkyl ($C_{10}$–$C_{15}$) benzene sulfonates; sodium alkyl glycerol ether sulfates, especially those ethers of the higher alcohols derived from tallow or coconut oil and synthetic alcohols derived from petroleum; sodium coconut oil fatty monoglyceride sulfates and sulfonates; sodium and potassium salts of sulfuric acid esters of higher ($C_8$–$C_{18}$) fatty alcoholalkylene oxide, particularly ethylene oxide reaction products; the reaction products of fatty acids such as coconut fatty acids esterified with isethionic acid and neutralized with sodium hydroxide; sodium and potassium salts of fatty acid amides of methyl taurine; alkane monosulfonates such as those derived from reacting alpha-olefins ($C_8$–$C_{20}$) with sodium bisulfite and those derived from reacting paraffins with $SO_2$ and $Cl_2$ and then hydrolyzing with a base to produce a random sulfonate; and olefin sulfonates which term is used to describe the material made by reacting olefins, particularly $C_{10}$–$C_{20}$ alpha-olefins, with $SO_3$ and then neutralizing and hydrolyzing the reaction product. The preferred anionic surfactants are ($C_{10}$–$C_{18}$) alkyl polyethoxy (1–11 Eo) sulfates and mixtures thereof having differing water solubilities.

Suitable nonionic surfactants include, in particular, the reaction products of compounds having a hydrophobic group and a reactive hydrogen atom, for example aliphatic alcohols, acids, amides and alkyl phenols with alkylene oxides, especially ethylene oxide, either alone or with propylene oxide. Specific nonionic surfactant compounds are alkyl ($C_6$–$C_{18}$) primary or secondary linear or branched alcohols condensed with ethylene oxide, and products made by condensation of ethylene oxide with the reaction products of propylene oxide and ethylenediamine. Other so-called nonionic surfactant compounds include long chain tertiary amine oxides, long-chain tertiary phosphine oxides, dialkyl sulfoxides, fatty ($C_8$–$C_{18}$) esters of glycerol, sorbitan and the like, alkyl polyglycosides, ethoxylated glycerol esters, ethyoxylated sorbitans and ethoxylated phosphate esters.

The preferred non-ionic surfactant compounds are those of the ethoxylated and mixed ethyoxylated-propyloxylated ($C_6$–$C_{18}$) fatty alcohol type, containing 2 –11 EO groups.

Examples of amphoteric surfactants which can be used in the compositions of the present invention are betaines and those which can be broadly described as derivatives of aliphatic secondary and tertiary amines in which the aliphatic radical can be straight chain or branched and wherein one of the aliphatic substituents contains from about 8 to about 18 carbon atoms and one contains an anionic water solubilizing group, e.g., carboxy, sulfonate, sulfate, phosphate, or phosphonate. Examples of compounds falling within this definition are sodium 3-dodecylaminopropionate, sodium 3-dodecylaminopropane sulfonate, N-alkyltaurines, such as prepared by reacting dodecylamine with sodium isothionate, N-higher alkyl aspartic acids and the products sold under the trade name "Miranol".

Examples of betaines useful herein include the high alkyl betaines such as. coco dimethyl carboxymethyl betaine, lauryl dimethyl carboxymethyl betaine, lauryl dimethyl alpha-carboxymethyl betaine, cetyl dimethyl carboxymethyl betaine, lauryl bis(2-hydroxyethyl) carboxy methyl betaine, stearyl bis-(2-hydroxypropyl) carboxymethyl betaine, oleyl dimethyl gamma-carboxypropyl betaine, lauryl bis-(2-hydroxypropyl) alpha-carboxymethyl betaine, etc. The sulfo-betaines may be represented by coco dimethyl sulfopropyl betaine, stearyl dimethyl sulfopropyl betaine, lauryl bis-(2-hydroxyethyl) sulfopropyl betaine, amino betaine amidosulfobetaines, and the like.

Other suitable betaines include 1-(lauryl, dimethylammonio) acetate-1(myristyl dimethylammonio) propane-3-sulfonate, 1-(myristyl di methylamino)-2-hydroxypropane-3-sulfonate, cocoamidoethylbetaine and cocoamidopropylbetaine.

The anionic surfactant or nonionic surfactant may be used alone or preferably a mixture of surfactants is present in the composition. The total amount of surfactant in the composition is at a level of from about 5 to 75 wt %, more preferably from about 5 to 35 wt % where the detergent is in liquid form. Where a 15 mixture of anionic and non-anionic surfactants are used, the mixture preferably contains at least about 40 wt % of the anionic surfactant.

The composition may also contain one or more detergency builders. The selection of particular builders from those known in the art is dictated by the fact that it is preferably not be a material that will generate a significantly basic pH above about 7.5, preferably not above 7.0, in the wash water, or in the detergent composition itself if it is in the form of a liquid, or at least is preferably not present in the detergent composition at levels high enough to generate such a pH. Thus known builders such as Zeolites are less preferred. as the main builder component because of proton exchange from the acidic detergent medium with the alkali metal, e.g., sodium cation, of the zeolite after a period of storage. Other builders which are less preferred as the main builder component include the alkali metal carbonates, bicarbonates, phosphates and silicates, since these materials also generate a more basic pH in an aqueous medium.

Preferred builders include organic builders, for example, polycarboxylate 30 builders, such as aminopolycarboxylates, for example, sodium and potassium ethylene-diamine tetraacetate; sodium and potassium nitrotriacetate; and the polyacetal polycarboxylates, such as those described, for example, in U.S. Pat. Nos. 4,144,226 and 4,315,092. Other organic builders of the polycarboxylate type include the water-soluble salts, especially sodium and potassium salts, of mellitic acid, citric acid, pyromellitic acid, benzene polycarboxylic acids, carboxymethyloxy succinic acid, cis-cyclohexane hexacarboxylic acid, and the like. Citric acid salt, e.g., potassium or sodium citrate, is often a preferred builder in non-phosphate or low phosphate formulations. In liquid detergent compositions, the citric acid salt also serves a dual function as a builder and an electrolyte which helps maintain the viscosity of the surfactant structure.

This is not to say that conventional builders which tend to generate a basic pH in aqueous medium cannot be used, particularly in granular or powder detergents. Such builders include phosphates such as sodium polyphosphate, and alkali or alkaline earth metal silicates, carbonates, and bicarbonates, as well as zeolites and like well known builders. However, when such builders are used, there may be a need to also include an amount of a weak acid in the formulation sufficient to lower the pH of the liquid detergent and the pH of the wash water to the required acidic to near-neutral range. Suitable such acids include mono or polycarboxylic acids such as citric acid, acetic acid, adipic acid, succinic acid, glutaric acid and the like, as well as mixtures thereof.

Where present, the builder is used at generally low levels of from about 1 to about 40 wt % of the detergent composition, more preferably from about 1 to 20 wt % of said composition.

The rinse-active pH-sensitive anti-foam agent for use in the present invention is a higher fatty acid, which may be saturated or unsaturated, and may contain from about 10 to about 22 carbon atoms, preferably from about 12 to 20 carbon atoms. Narrow cut lauric, myristic, oleic, and stearic acids and natural coconut, palmitic and tallow fatty acids are especially preferred in amounts of from 0.1 to about 10% by weight of the composition. At the alkaline pH values in the rinse water, these higher fatty acids function in the detergent compositions as anti-foaming agents by forming soap surfactants in combination with neutralizing cations, e.g., sodium or potassium, present in the composition. The soaps further react with hardness ions (e.g., magnesium and calcium) in the rinse water to form heavy metal insoluble soaps which are effective foam suppressors.

The detergent composition may also contain one or more softening components known in the art. For reasons discussed above, preferred softeners are those materials which will not generate a basic wash water pH or materials which are not present in the composition at levels sufficient to generate a basic pH above 7.0, preferably not above 6.5. Suitable softeners include swelling bentonite clays such as sodium and calcium montmorillonites, sodium saponites and sodium hectorites. These may be present in the detergent composition at levels of from about 0.5 to 20 wt % , more preferably from about 5 to 15 wt %.

Other conventional materials which may also be present in the liquid detergent compositions of the invention, include for example, soil-suspending agents, thickening agents, sequesterants such as salts of ethylene diamine tetraacetic acid or analogous phosphonic acid salts, hydrotropes, corrosion inhibitors, dyes, perfumes, optical brighteners, suds boosters, germicides, e.g., quaternary ammonium salts, preservatives, e.g., quaternium 15, anti-tarnishing agents, opacifiers, oxygen-liberating bleaches such as sodium perborate or percarbonate with or without bleach precursors, buffers and the like. Such other conventional materials may be used in the amounts they are normally used generally up to about 5% by weight, more preferably up to about 3% by weight, although higher amounts which do not interfere with the stability of the composition or give rise to an unacceptably high pH may be used, if desired.

The detergent compositions of the present invention may be in liquid or in granular form. The liquid carrier for the liquid compositions of this invention is preferably water alone, but an aqueous carrier containing minor amounts of a lower alcohol, such as ethanol or isopropanol, may also be used in some cases. Generally, water levels may be up to about 90% by weight of the composition, for example, from about 20% to about 90%, preferably from about 20% to 70%, by weight. The water may be deionized, but usually tap water is sufficient.

The viscosity of the liquid detergent is normally in the range of about 200 to 10,000 centipoises, preferably 600–3,000 centipoises, but products of other suitable viscosities may also be useful. At the viscosities mentioned, the liquid detergent is pourable, stable, nonseparating and uniform.

As necessary, pH modifiers, such as water soluble bases, e.g., NaOH, KOH, amines, or ammonia, may be added to the detergent composition in order to obtain the desired pH level in the washing bath. The preferred wash water pH will range from about 5.0 up to less than 7.0 and most preferably from about 5.5 up to 6.9.

Where the detergent composition is in the form of a liquid, the liquid will exhibit a pH within the range of about 4.5 to about 6.5.

Powder or granular forms of the detergent composition may be prepared by conventional granulation techniques, such as spray drying, wherein a liquid formulation (crutcher slurry) is spray dried and the resulting granular product collected. The crutcher slurry also preferably will contain one or a mixture of granulation aids such as sodium sulfate, silicates, clays and other well known material as such as disclosed in U.S. Pat. Nos. 5,024,778 and 5,332,513. The amount of such granulation aids will generally range from about 10 to 50 wt %. The water content of such granular detergents generally ranges from about 5 to 15 wt %.

The detergent compositions of this invention are suitable for use as laundry detergents for fine fabrics, dish washer detergents, shampoos, body lotions and the like and may be modified by inclusion of specific known ingredients to accommodate these applications, e.g., dispersing agents, skin conditioning agents, anti-dandruff agents and the like.

Conventional manufacturing methods may be used to formulate the liquid detergent composition. In one procedure, a portion of the aqueous medium may be added to a mixing vessel and the surfactant components may be mixed therewith in any suitable order, followed by addition of builder, acidic components and sufficient neutralizing base, e.g., KOH, to produce the desired pH. Softeners, enzyme, water soluble polymer, minors, e.g., perfume, optical brighteners, foam control agents, and the balance of water may then be added and mixing continued to form an aqueous dispersion. Granular forms of the detergent may be prepared by spray drying a liquid formulation to a water content of up to about 15 wt %, followed by the addition of any volatiles after spray dry processing.

The detergents of the invention are generally added to wash water at levels in the range of about 0.05 to 0.30 wt %. For conventional washing machines, detergents in the form of liquids are preferably added at levels in the range of from about 60 to 240 ml per load; powder detergents are preferably used at levels of about 60 to 300 grams per load.

The detergent composition may also contain one or more enzymes which are active against biodegradable stains, e.g., starches, vegetable and blood, and which are also active at a pH of about 5 to about 12, more preferably at a pH of 7 or below. Preferred enzymes which may be used include amylolytic enzymes (alpha amylases), alkaline and neutral proteases, lipolases, cellulases and the like, and mixtures thereof.

Alkaline or neutral proteolytic enzymes suitable for the present composition include the various commercial liquid enzyme preparations which have been adapted for use in detergent compositions. Enzyme preparations in powdered form are also useful although, as a general rule, less convenient for incorporation into a built liquid detergent composition. Thus, suitable liquid enzyme preparations include "Alcalase" and "Savinase" , trademarked products sold by Novo Industries, Copenhagen, Denmark, and "Maxatase", "Maxacal", "Maxaperm" and "AZ-Protease" sold by Gist-Brocades, Delft, The Netherlands. Low pH active enzymes such as Alcalase and Maxatase are preferred as compared with enzymes active at high pH.

Other suitable alpha-amylase liquid enzyme preparations are those sold by Novo Industries and Gist-Brocades under the tradenames "Termamyl" and "Maxamyl", respectively. Another enzyme preparation which may be used is a powdered enzyme preparation containing alpha-amylase and a mixture of alkaline and neutral proteases available as CRD-Protease from the Monsanto Co of St. Louis, Mo.

Where used, the enzymes are normally present in the detergent composition at a level of from about 0.01 up to about 5 wt %, more preferably from about 0.1 to 2 wt %.

The composition may also contain a suitable stabilizer system for the enzyme such as up to 1 wt % calcium chloride or the combination of boric acid, boric oxide or alkali metal borate and water soluble calcium salt as disclosed in U.S. Pat. No. 5,364,533.

EXAMPLE 1

The performance of an acidic liquid laundry detergent composition in accordance with the invention was compared in hand wash operation to a conventional commercial fine fabric liquid detergent. The parameters compared were the pH in the wash and rinse and the amount of foam generated during washing and the ease of removal of such foam during successive rinsing steps.

The composition of the liquid detergent of the invention is described below.

| COMPONENT | WEIGHT PERCENT |
|---|---|
| (anionic) $C_{12}$–$C_{14}$ alcohol 3:1 sodium sulfate | 7.5% |
| (nonionic) $C_{13}$–$C_{15}$ alcohol (7 EO) | 1.5 |
| (nonionic) $C_{13}$–$C_{15}$ alcohol (11 EO) | 1.5 |
| Fatty Acid (lauric/myristic) | 0.9 |
| Citric Acid | 3.0 |
| Sokalan DCS[(1)] | 2.0 |
| KOH | Adjusted to pH = 4.7 |
| Water | Balance |

[(1)]Sokalan DCS is a commercial mixture of adipic, glutaric, and succinic diacids marketed by BASF.

The pH of the above-described liquid is 4.7, as adjusted by the level of KOH in the composition.

A commercial conventional fine fabric liquid detergent having a pH of about 7.5 was used for comparative purposes as described herein.

The pH and foam level in the wash and rinse water is shown below for a hand washing and rinsing operation wherein the use of the conventional liquid is compared to the liquid detergent composition of the invention.

Foam level was evaluated visually by a five-member panel which assigned a grade from 0 to 10 during a hand wash of a woolen sweater in a 5 liter bath. A grade of zero corresponds to the total absence of foam, and a grade of 10 corresponds to a maximum, high-foam condition.

pH and Foam Level in Hand Washing and Rinsing Using Tap Water of pH = 8.0–8.5

| | pH of Water in Wash and in Rinse | | Foam Level Scoring (0 to 10 Scale) | |
|---|---|---|---|---|
| | Conventional Liquid | Liquid Composition of the Invention | Conventional Liquid | Liquid Composition of the Invention |
| Washing | 7.7 | 6.2 | 10.0 | 10.0 |
| 1st Rinse | 7.8 | 7.2 | 9.0 | 9.0 |
| 2nd Rinse | 7.8 | 7.4 | 6.5 | 2.5 |
| 3rd Rinse | 7.8 | 7.5 | 3.5 | 0.5 |
| 4th Rinse | 7.8 | — | 2.0 | — |
| 5th Rinse | 7.8 | — | 1.5 | — |

As noted in the table, when using the conventional liquid detergent composition, the pH of the wash water and the pH of the rinse water are nearly the same and remain substantially constant. The pH in the rinse is determined principally by the effect of dilution with tap water which has a pH only slightly above the pH of the wash water. The foam level is only moderately decreased with each succeeding rinse and a measurable amount of foam is still present after five rinses.

In contrast thereto, when using the composition of the invention, there is a marked difference in pH between the mildly acidic wash and the slightly alkaline rinse as noted in the table resulting in an almost complete removal of foam after the third rinse.

We claim:

1. A method of laundering fabrics which provides improved protection of fine fabrics during washing and enhanced removal of generated foam during rinsing in hand wash comprising:

(a) providing a wash bath containing an effective amount of a mildly acidic laundry detergent composition which generates a pH of from about 5.5 to 6.9 in the wash bath, said detergent composition comprising:
  (i) at least one anionic surfactant; and/or
  (ii) at least one nonionic surfactant; and
  (iii) a rinse-active, pH-sensitive foam control agent comprising a fatty acid; said wash water pH being sufficiently acidic to prevent the complete neutralization of the fatty acid to a soap;

(b) subjecting the fabrics to be laundered to a washing action in the wash bath whereby the fatty acid foam control agent remains substantially in acid form at the pH of the wash bath so as to be essentially inoperative to suppress foam during washing; and (c) rinsing the washed laundry of step (b) with tap water having a pH of from about 7.5 to 8.5 whereby at least a portion of said fatty acid is converted to a soap which functions to suppress foam during rinsing.

2. The method of claim 1 wherein said anionic surfactant is an ethoxylated alcohol sulfate.

3. The method of claim 1 wherein said nonionic surfactant is an ethoxylated alcohol.

4. The method of claim 1 wherein said fatty acid is selected from among lauric, myristic, oleic or stearic acid.

5. The method of claim 1 wherein said detergent composition is in the form of a liquid and contains at least 50 wt % water.

6. The method of claim 1 wherein said detergent composition is in powder or granular form.

* * * * *